US006523718B1

(12) United States Patent
Chan

(10) Patent No.: US 6,523,718 B1
(45) Date of Patent: Feb. 25, 2003

(54) GOLF BALL DISPENSING APPARATUS

(76) Inventor: Kin-Keung Chan, 839 Clare Crescent, Prince George, British Columbia (CA), V2M 7E2

( * ) Notice: Subject to any disclaimer, the term of this patent is extended or adjusted under 35 U.S.C. 154(b) by 0 days.

(21) Appl. No.: 09/685,840

(22) Filed: Oct. 9, 2000

Related U.S. Application Data

(63) Continuation-in-part of application No. 09/034,236, filed on Mar. 4, 1998, now Pat. No. 6,129,242.

(51) Int. Cl.[7] ..... B65G 59/00
(52) U.S. Cl. ..... 221/271; 473/136
(58) Field of Search ..... 221/271, 268, 221/272, 289; 473/132, 136, 137

(56) References Cited

U.S. PATENT DOCUMENTS

| | | | | |
|---|---|---|---|---|
| 3,410,452 A | | 11/1968 | Igel et al. | 221/13 |
| 3,756,606 A | * | 9/1973 | Land | 473/136 |
| 3,901,515 A | * | 8/1975 | Mozel | 473/136 |
| 4,046,286 A | | 9/1977 | Peppard | 221/251 |
| 4,892,318 A | | 1/1990 | Jennings | 273/201 |
| 5,096,200 A | | 3/1992 | Komori et al. | 273/201 |
| 5,322,291 A | * | 6/1994 | Smith et al. | 473/136 |
| 5,372,277 A | | 12/1994 | Waring | 221/68 |

FOREIGN PATENT DOCUMENTS

| | | |
|---|---|---|
| GB | WO 94/07218 | 3/1994 |

* cited by examiner

*Primary Examiner*—Kenneth W. Noland
(74) *Attorney, Agent, or Firm*—Oyen Wiggs Green & Mutala

(57) ABSTRACT

A ball housing and dispensing apparatus comprises a housing container capable of housing a plurality of golf balls and a ball dispenser having a gate member to allow a golfer to selectively control the dispensation of a single golf ball at a time, without requiring the golfer to alter his stance prior to each swing or putt. The gate member has first and second portions attached through a connecting member, so as to allow the first and second portions to reciprocate in unison with each other across a passageway. The ball dispenser has a hold position and a dispensing position, according to which one of the reciprocating portions of the gate member is retracted from a passageway and which enters into the passageway. In one embodiment, the reciprocation of the gate member is driven by a solenoid which is attached to the gate member by a spring. In an alternative embodiment the dispenser is adapted to place a golf ball on a tee at the striking location. In the alternative embodiment the first and second gate member portions are curved in an arc and pivot relative to the passageway. The dispenser further comprises a ball placement assembly also. pivotably coupled to the passageway for placing a discharged golf ball on to the tee in the dispensing position.

19 Claims, 9 Drawing Sheets

GOLF BALL DISPENSING APPARATUS

This is a continuation-in-part of application Ser. No. 09/034,236 which is now U.S. Pat. No. 6,129,242, filed on Mar. 4, 1998.

TECHNICAL FIELD

This invention relates to an apparatus for holding a plurality of golf balls and for controllably dispensing a single ball at a time to a pre-determined striking location without requiring the golfer to alter his stance prior to each swing or putt.

BACKGROUND

Golf ball dispensing and teeing apparatuses for use at driving ranges and the like are well known in the prior art. Representative prior art patent documents include:

U.S. Pat. No. 4,892,318 to Jennings

U.S. Pat. No. 5,096,200 to Komori et al.

U.S. Pat. No. 5,372,277 to Waring

WO 94/07218 to Hagen International (UK) Limited

WO 94/12247 to Lesco Enterprises Limited

Unfortunately, all of the aforementioned prior art references suffer from one or more disadvantages. For example, some devices include systems that dispense or position a ball according to a pre-determined time interval. This has the undesired effect of the golfer either having to wait too long for a ball to be dispensed or being rushed between swings. The present invention aims to overcome this deficiency by allowing the golfer to controllably dispense a single ball when desired.

Another problem encountered in the prior art is that some apparatuses require permanent or semi-permanent installation at a driving range for operability. Unfortunately, mounting a ball dispenser in this manner limits its applications. In contrast, the present invention requires no mounting and is easily transported. As a result, the present invention may be used in any number of different locations including not only a driving range, but also a practise chipping or putting surface or sand bunker.

Finally, some prior devices incorporate complex mechanisms and structures for conveying golf balls from a storage container to a dispenser or for placing a ball on a tee, thus rendering them commercially infeasible or vulnerable to mechanical breakdown over time. The present invention aims to overcome these deficiencies by providing a commercially viable apparatus for holding and dispensing balls that is much less vulnerable to mechanical failure.

SUMMARY OF INVENTION

A golf ball dispensing apparatus is disclosed comprising a container for holding a plurality of golf balls; and a ball dispenser for selectively dispensing the golf balls one at a time from the container to a striking location. The ball dispenser comprises a passageway having an inlet for receiving the golf balls and an outlet; a gate member located between the inlet and the outlet and having first and second portions moveable into the passageway to restrict the passage of the golf balls therethrough; and actuating means to move the gate member between a dispensing position and a hold position. In the dispensing position the first portion of the gate member extends substantially into the passageway and the second portion of the gate member retracts substantially from the passageway, while in the in the hold position the first portion retracts substantially from the passageway and the second portion extends substantially into the passageway.

The apparatus may further include a connecting element connecting the first portion to the second portion such that the first and second portions reciprocate in unison relative to the passageway when the gate member moves between the dispensing and hold positions. The passageway is an elongated conduit having a longitudinal axis and the first and second gate portions move in spaced-apart transverse planes intersecting the longitudinal axis. Preferably the first and second gate portions extend in parallel planes and are longitudinally spaced-apart slightly less than the diameter of one of the golf balls. In the dispensing position, the first gate member physically separates a golf ball to be dispensed from any other golf balls loaded in the passageway. Preferably the passageway slopes downwardly from the inlet to the outlet such that the golf ball to be dispensed rolls from the dispenser to the striking location by gravitational forces. The container may also be inclined to funnel golf balls toward the ball dispenser inlet. Preferably the inlet is sized to accommodate only one ball at a time.

The apparatus may further include means for biasing the gate member toward said hold position. Preferably the biasing means comprises a coil spring connected to an end of the gate member. The actuating means may consist of a mechanical plunger for moving the gate member to the dispensing position against the bias of the spring. Operation of the plunger is preferably controlled by an electric solenoid. The actuating means may be connected to a source of solar power.

A golf ball dispenser component is also disclosed which may be sold and used separate from the golf ball container. The dispenser selectively dispenses golf balls one at a time to a striking location and includes a passageway having an inlet for receiving the golf balls and an outlet; a gate member located between the inlet and the outlet and having first and second portions moveable into the passageway to restrict the passage of the balls therethrough; and actuating means to move the gate member between a dispensing position and a hold position. In the dispensing position the first portion of the gate member extends substantially into the passageway and the second portion retracts substantially from the passageway, while in the in the hold position the first portion retracts substantially from the passageway and the second portion extends substantially into the passageway.

In an alternative embodiment of the invention, a golf ball dispensing apparatus is disclosed for dispensing golf balls one at a time to a golf tee located at the striking location. In this embodiment the gate member assembly comprises first and second gate member portions which are curved in an arc. The first and second portions are preferably radially spaced apart a distance approximating the diameter of a conventional golf ball and are moveable through slots formed in the ball discharge conduit. Preferably the gate member is pivotably coupled to a forward portion of the discharge conduit. The alternative apparatus farther comprises a ball placement assembly which is also pivotable relative to the discharge conduit in unison with the gate member assembly. The ball placement assembly includes an elongated run-off track for receiving each ball discharged from the discharge conduit outlet and delivering it to a ball guide located at a free end of the track remote from the discharge conduit. A ball guide is located at the track free end for gently guiding the ball on to the tee at the striking location.

Pivoting motion of the gate member assembly and ball placement assembly may be driven by any suitable actuator, such as a pulley and drive belt assembly coupled to a reversible DC motor. The actuator may be activated by the user at remote location. As in the first embodiment of the invention, this permits the user to activate the dispensing apparatus at the striking location without altering his or her stance.

BRIEF DESCRIPTION OF DRAWINGS

In the drawings which illustrate the preferred embodiment of the invention, but which should not be construed as restricting the spirit or scope of the invention in any way.

DESCRIPTION

The invention provides a golf ball dispensing apparatus 10 for holding a plurality of golf balls 12 and controllably dispensing balls 12 one at time to a pre-determined ball striking location (such as a driving range mat).

Figure 1:
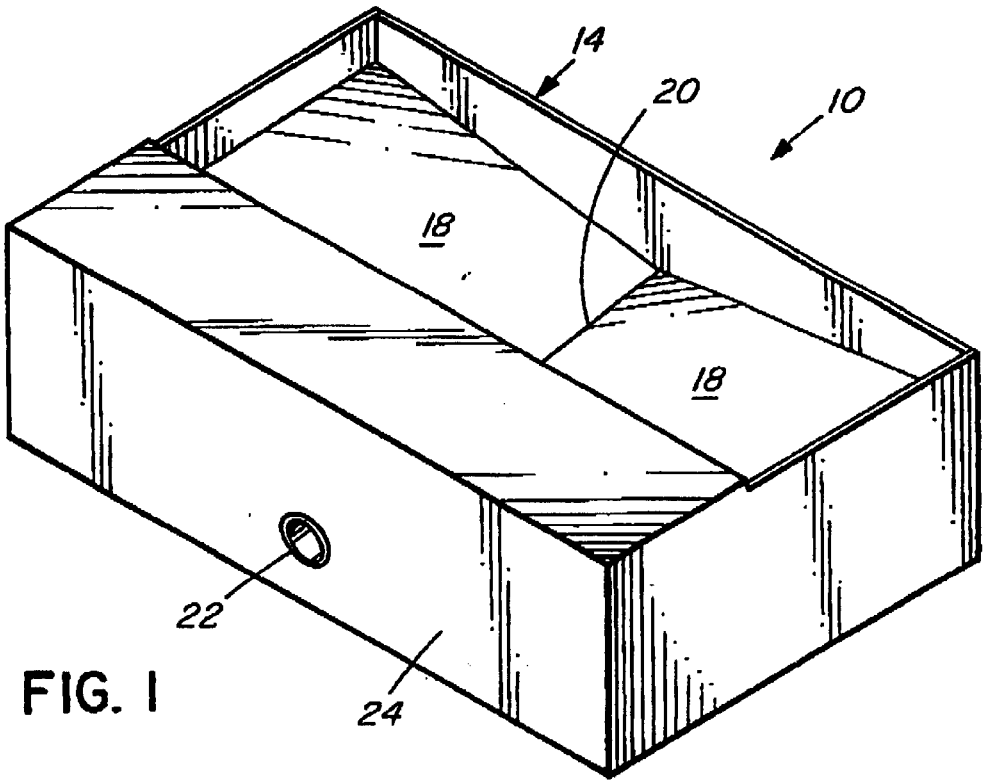
FIG. 1 is a top perspective view of the container component of the applicant's golf ball dispensing apparatus.
Figure 2:
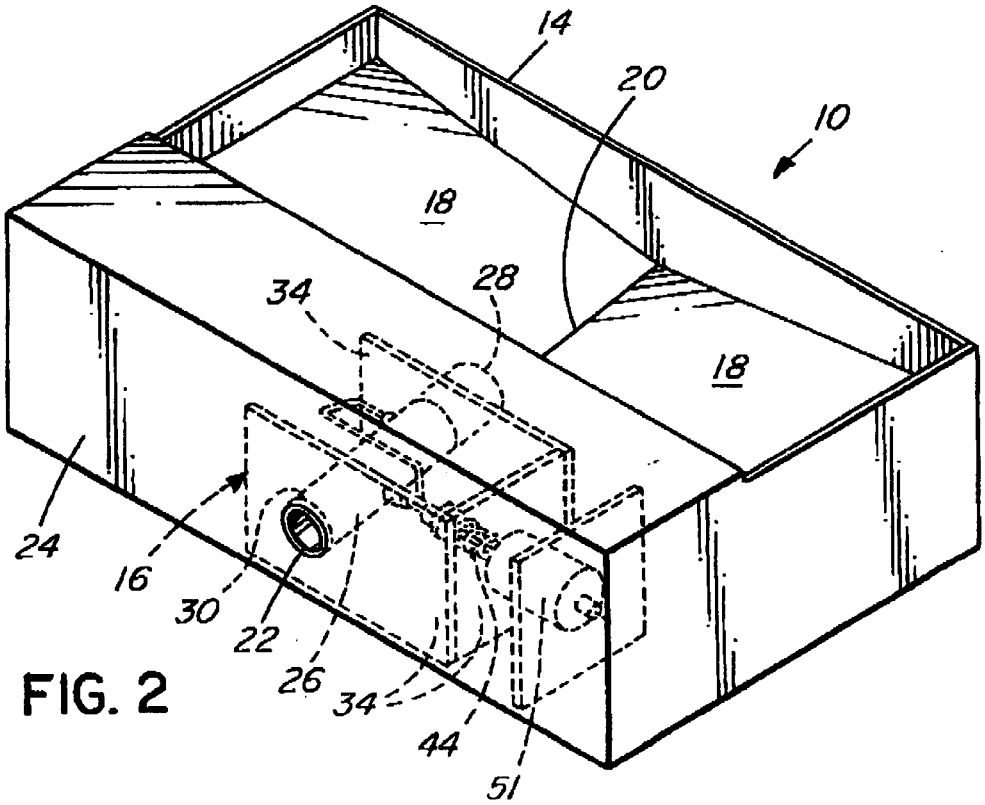
FIG. 2 is a top perspective view of the ball dispenser component of the applicant's golf ball dispensing apparatus shown in dotted outline mounted within the container of FIG. 1.

Dispensing apparatus 10 includes a ball container 14 (FIG. 1) and a ball dispenser 16 (shown in dotted outline in FIG. 2). Container 14 includes opposed bottom panels 18 which are downwardly inclined toward a central trough 20. Trough 20 slopes forwardly for funneling golf balls 12 by gravitational forces toward dispenser 16. In the illustrated embodiment, dispenser 16 is mounted in a forward portion of container 14 for conveying golf balls 12 from trough 20 through an outlet 22 formed in a front panel 24 of container 14. In use, container 14 is positioned so that each ball 12 dispensed through outlet 22 will roll to the desired ball striking position. Container 14 is preferably constructed of a hard, durable plastic, so as to be capable of withstanding variable weather conditions.

Ball dispenser 16 includes an elongated passageway 26 having an inlet 28 at the lowermost end of container trough 20 and an outlet 30 which is aligned with container outlet 22 (FIG. 2). Passageway 26 may comprise, for example, an inclined open-ended tube. The longitudinal axis of passageway 26 is substantially aligned with container trough 20 and is inclined downwardly from inlet 28 to outlet 30. Passageway 26 is supported in the inclined position by a housing 32 consisting of vertical wall panels 34. Inlet 28 is sized to receive only one golf ball 12 at a time from trough 20.

It will be appreciated that passageway 26 need not necessarily be sloped. An alternate embodiment could be imagined whereby balls 12 are automatically and continuously propelled through passageway 26 by a driven component (not shown) rather than by gravity.

Figure 3:
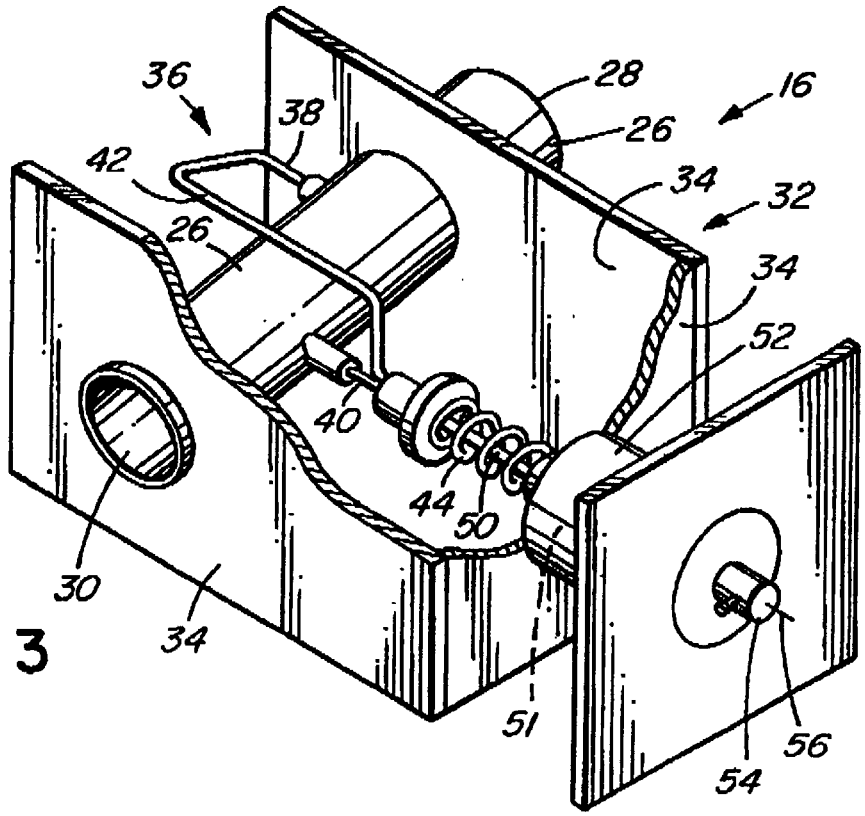
FIG. 3 is a top perspective view of the ball dispenser of FIG. 3.
Figure 4:
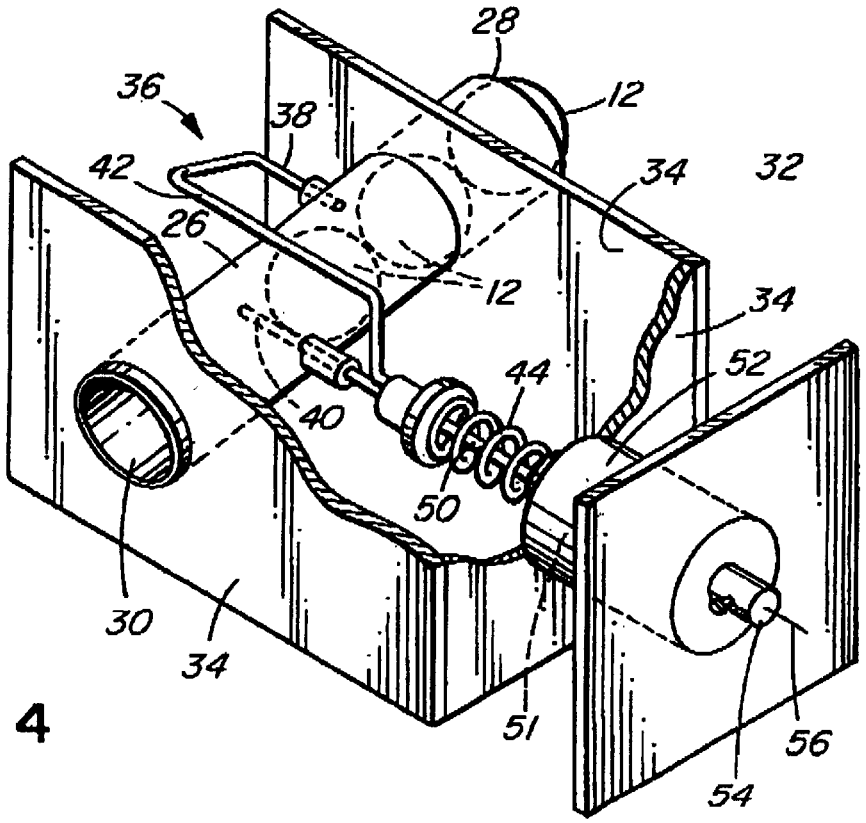
FIG. 4 is a top perspective view of the ball dispenser of FIG. 3 in the hold position illustrating the first and second portions of the gate member and several golf balls loaded in the ball dispenser in dotted outline.
Figure 5:
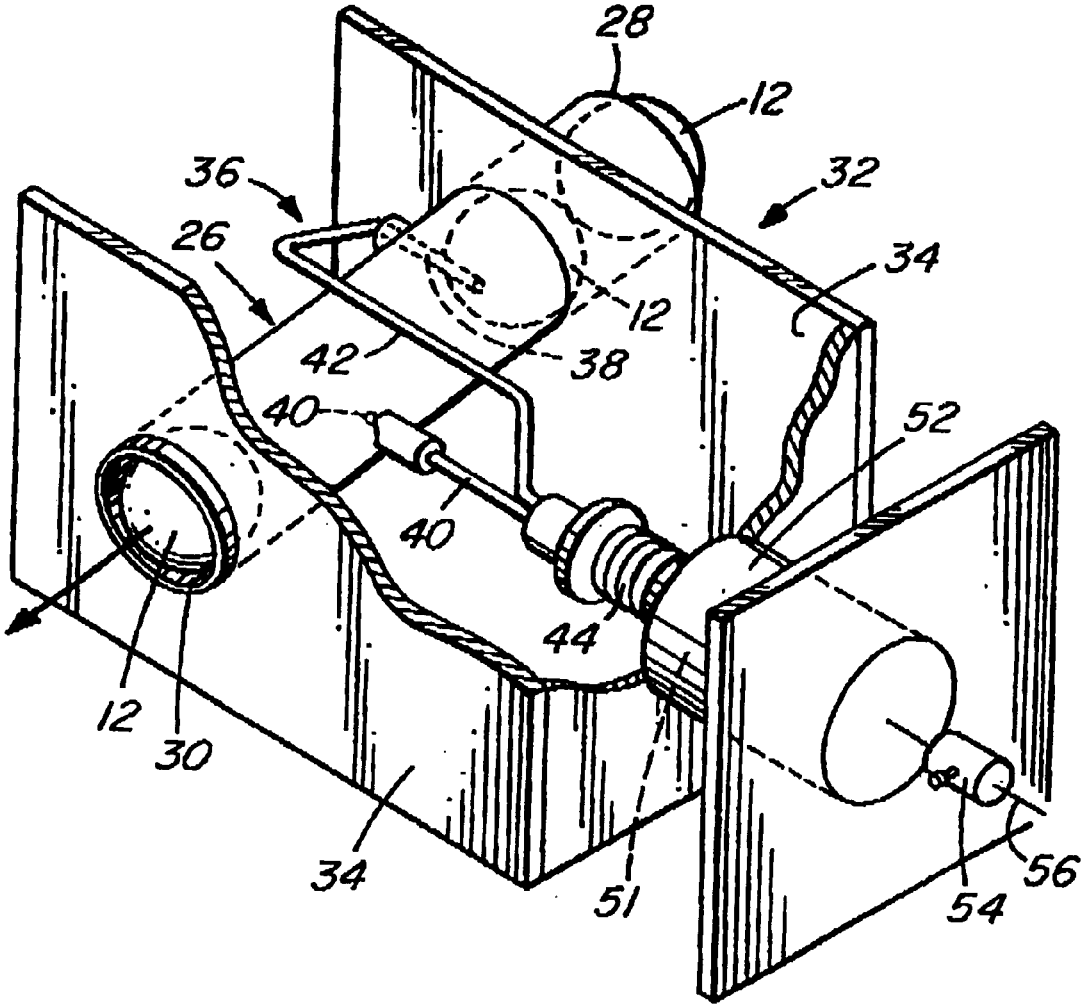
FIG. 5 is a top perspective view of the ball dispenser of FIG. 3 in the dispensing position illustrating the first and second portions of the gate member and several golf balls loaded in the dispenser in dotted outline.

As shown best in FIGS. 3–5, ball dispenser 16 further includes a gate member generally designated 36. Gate member 36 includes a first gate portion 38 and a second gate portion 40 which are joined together by a connecting element 42. Gate portions 38,40 extend in spaced-apart parallel planes transverse to the longitudinal axis of passageway 26. As described further below, gate portions 38, 40 reciprocate transversely into and out of the interior of passageway 26 to control the advancement of golf balls 12 moving therethrough. Gate portions 38, 40 are preferably spaced-apart slightly less than the diameter of a single golf ball 12. Portion 38 is disposed at a transverse position closer to passageway inlet 28 than portion 40.

Gate member 36 is moveable between a hold position (FIG. 4) and a dispensing position (FIG. 5). In the hold position, gate portion 40 extends into the interior of passageway 26 to obstruct the passage of golf balls 12 loaded therein and gate portion 38 is substantially retracted from the interior of the passageway 26. When gate member 36 is adjusted to the dispensing position of FIG. 5, gate member 40 is substantially retracted from the interior of passageway 26 which permits the forwardmost golf ball 12 loaded in passageway 26 to roll by gravitational forces through outlet 30 (which is aligned with container outlet 22 as shown in FIG. 2). In the dispensing position, gate member 38 extends substantially into the interior of passageway 26 to obstruct the passage of the next-in-sequence golf balls 12. This ensures that only one ball at a time is discharged from apparatus 10 in the dispensing position.

Gate member 36 is biased toward the hold position of FIG. 4 by a coil return spring 44 which has a first end 46 secured to an end of gate member 40 and connecting element 42. A second end 48 of spring 44 is connected to an "actuating means" which acts against the bias of spring 44. The actuating means may comprise a mechanical plunger which moves within a housing and is controlled by an electric solenoid. When solenoid is energized, control the movement of gate member 36 to the dispensing position. In particular, Spring 26 has a first end 40 and a second end 42. First end 40 is connected to gate-member 22 and second end 42 is connected to solenoid 24. Solenoid 24 drives the reciprocating movement of first portion 34 and second portion 36 across sloped passageway 20 by causing spring 26 to contract and expand. The reciprocating movement is best illustrated with reference to FIGS. 4 and 5.

FIG. 4 illustrates the preferred embodiment of ball dispenser 18 in the hold position, while FIG. 5 illustrates the preferred embodiment of ball dispenser 18 in the dispensing position.

In the hold position, solenoid 24 is not energized. As a result, spring 26 remains expanded, causing first portion 34 of gate-member 22 to be substantially retracted from sloped passageway 20 and second portion 36 of gate-member 8 to enter sloped passageway 20, thus preventing a first golf ball 13 from being dispensed from ball dispenser 18.

In contrast, in the dispensing position, solenoid 24 is energized causing spring 26 to contract and second portion 36 of gate-member 22 to be substantially retracted from passageway 20, thus allowing first golf ball 13 to be dispensed from golf ball housing and dispensing apparatus 10 to a pre-determined striking location. The dispensation of first golf ball 13 is illustrated by the dotted arrow in FIG. 5. Coincident with the retraction of second portion 36 of gate-member 22 from: sloped passageway 20, first portion 34 of gate-member 22 enters passageway 20, thus preventing the dispensation of golf balls 12. In this manner, only a single golf ball, first golf ball 13 in this case, is dispensed at a time.

In operation, the dispensation of golf balls 12 is prevented by the entrance of second portion 36 of gate-member 22 into sloped passageway 20 when gate-member 22 is in the hold position (see FIG. 4). When gate-member 22 reciprocates from the hold position to the dispensing position, first golf ball 13 is dispensed from sloped passageway 20, and ultimately from golf ball housing and dispensing apparatus 10. As first golf ball 13 is dispensed, first portion 34 of gate-member 22 enters into sloped passageway 20. Accordingly, the next-in-line ball is held in position by first portion 34 (see FIG. 5) and is prevented from being dispensed coincidentally with first golf ball 13. The next-in-line ball advances against second portion 36 when gate-member 22 reciprocates and second portion 36 again enters sloped passageway 20. The next-in-line ball is then dispensed according to the above description and this cycle is repeated whenever a golfer wants to dispense a ball.

The ability of the golfer to select between the reciprocating hold and dispensing positions may be controlled by a foot-activated or club head-activated pedal found in close proximity to the golfer (not shown). By activating the pedal, the golfer is able to controllably dispense golf balls 12 to a pre-determined striking location without significantly altering his stance or alignment.

The dispensation of golf balls 12 from golf ball dispensing apparatus 10 is made to a striking location (not shown) where a golfer will strike the ball. It will be appreciated that the distance between the striking location and the housing and dispensing apparatus 10 is primarily a function of the angle of inclination of sloped passageway 26. That is, by increasing the angle of inclination of sloped passageway 26, the striking location will be accordingly moved farther away from golf ball dispensing apparatus 10 and vice versa.

FIGS. 6–11 illustrate an alternative embodiment of the invention for controllably dispensing a golf ball 12 on to a golf tee 100 located at the striking location. For example, golf tee 100 may be located on an artificial grass hitting mat 102 of the type typically used at golf driving ranges.

Figure 6:
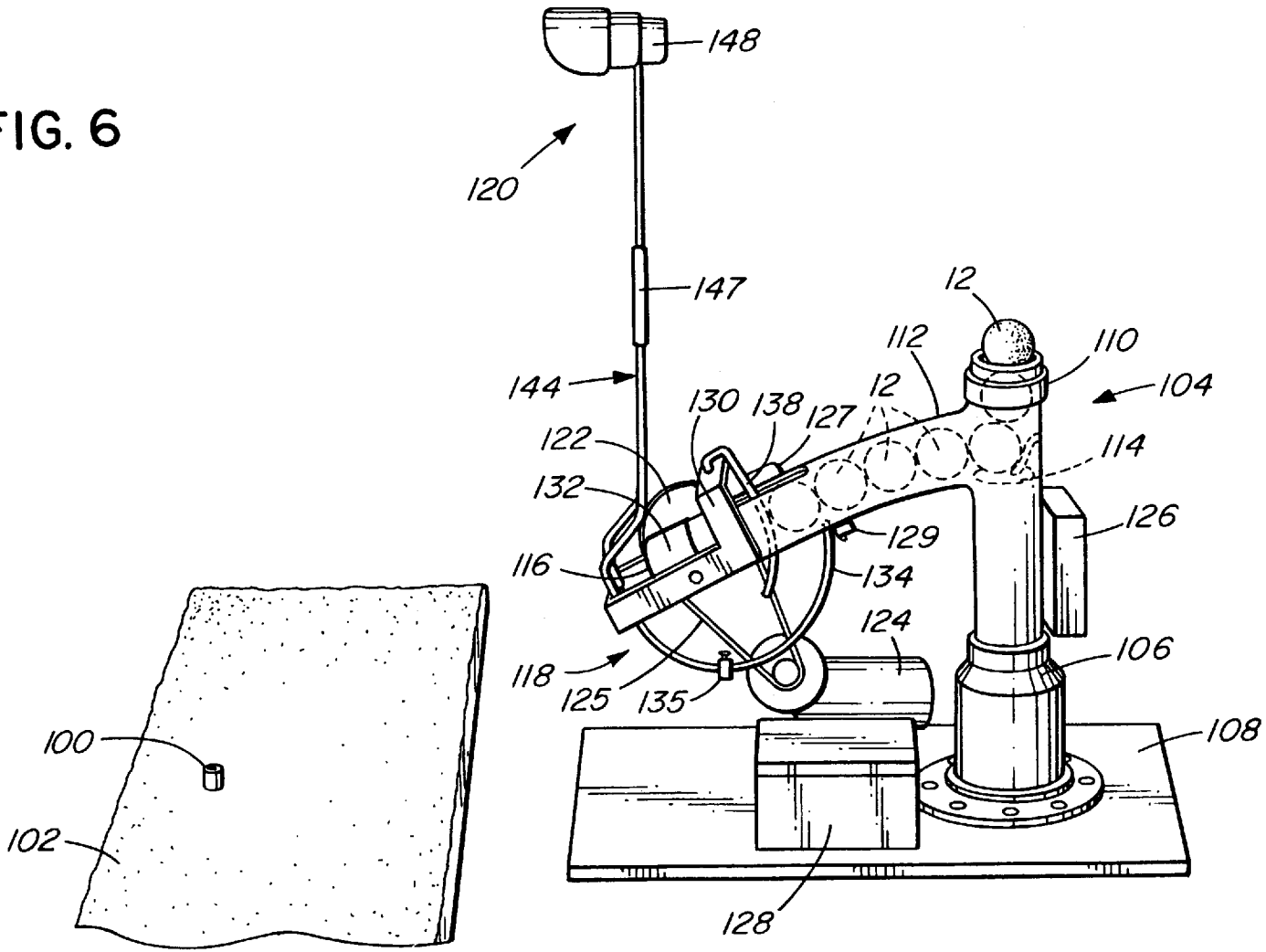
FIG. 6 is a perspective view of an alternative embodiment of the applicant's golf ball dispensing apparatus designed to place a golf ball on a tee at the striking location and showing the apparatus in the hold position.

In this alternative embodiment of the invention, golf ball dispenser 104 consists of an upright support stand 106 mounted on a base 108. Support stand 106 has a ball inlet 110 at its upper end for receiving a plurality of golf balls 12 (for example, from a container holding a large number of balls). A ball discharge tube 112 is inclined downwardly from an upper portion of support stand 106. A blocker plate 114 is located within support stand 106 for diverting golf balls 12 loaded into inlet 110 into discharge tube 112 (FIG. 6). Discharge tube 112 has an outlet 116 at its lower end remote from support stand 106. Golf balls 12 roll down discharge tube 112 toward outlet 116 by gravitational forces.

Golf ball dispenser 104 also includes a gate assembly 118 for advancing balls 12 from discharge tube 112 one at a time and a ball placement assembly for depositing each golf ball dispensed from discharge tube 112 on to tee 100. Gate assembly 118 and ball placement assembly 120 are coupled together and pivot in unison between hold and dispensing positions, as discussed further below. As discussed further below, in the hold position gate assembly 118 and/or ball placement assembly 120 contacts a microswitch 127 mounted on discharge tube 112.

Pivoting movement of gate assembly 118 and ball placement assembly 120 is driven by a user-activated actuator such as a pulley 122 coupled to a reversing DC motor by means of a drive belt 125. Motor 124 is connected to an external power source. As discussed further below, activation of the actuator is controlled by a remote control assembly 126 coupled to a battery 128.

Figure 11:
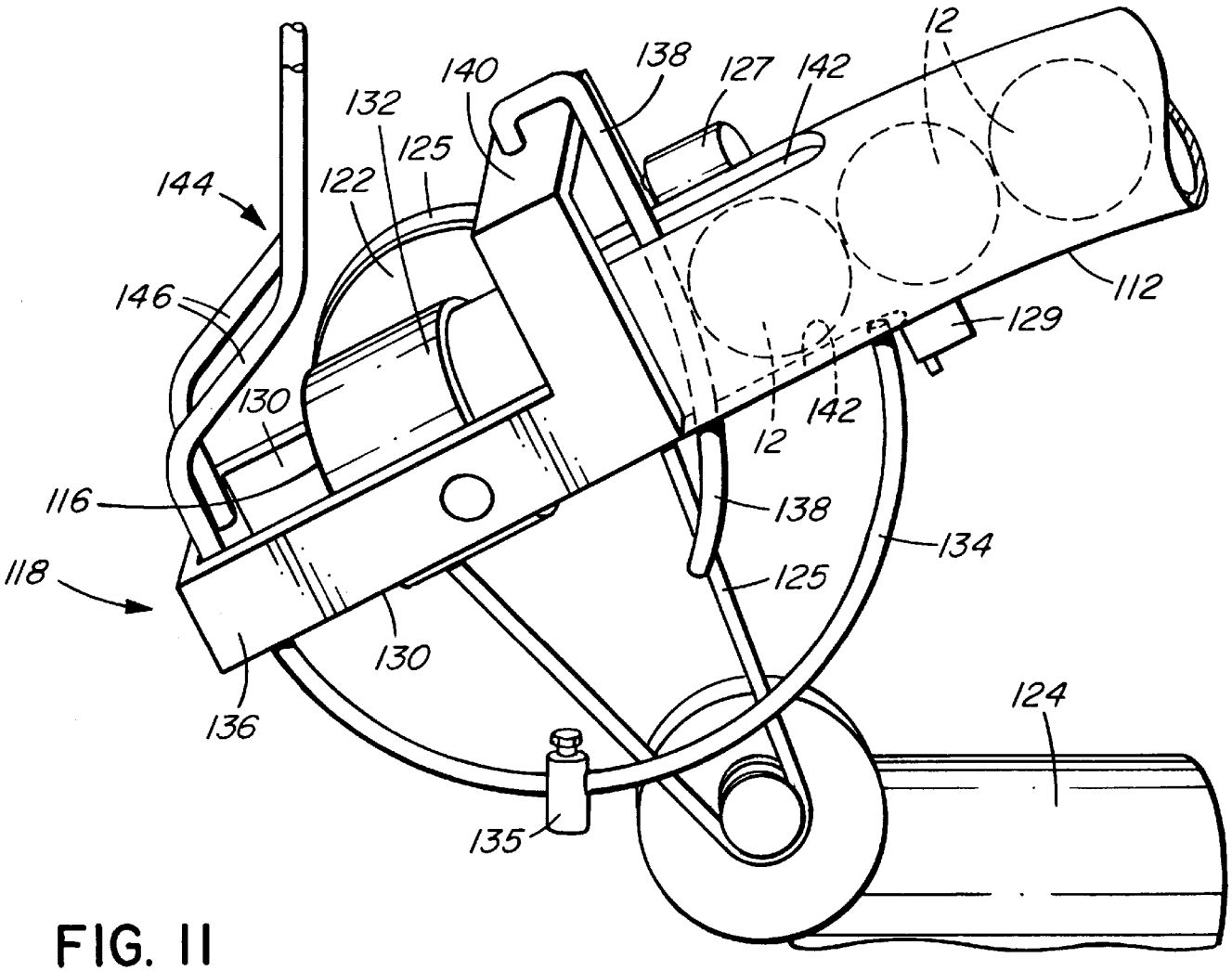
FIG. 11 is an enlarged perspective view of the apparatus of FIG. 6 showing the gate member assembly in the hold position.

As shown best in FIG. 11, gate assembly 118 includes a pair of spaced-apart parallel support arms 130 which are pivotably coupled to a collar 132 surrounding discharge tube 112 at outlet 116. A first gate member 134 is coupled to a first end 136 of support arms 130 and a second gate member 138 is coupled to a second end 140 of support arms 130. Unlike the first embodiment of the invention described above, both gate members 134, 138 are curved in an arc. Gate members 134, 138 are moveable through slots 142 formed in discharge tube 112. The radial spacing between gate members 134, 138 is preferably slightly larger than the diameter of a golf ball 12.

In the hold position shown in FIGS. 6 and 11 gate member 138 extends through a slot 142 into the interior of discharge tube 112 to obstruct the passage of golf balls 12 loaded therein and gate member 134 is substantially retracted from discharge tube 112. When ball dispenser 104 is adjusted to the dispensing position of FIGS. 7 and 8, gate member 138 is substantially retracted from the interior of discharge tube 112 which permits the forwardmost golf ball 12 loaded in tube 112 to roll by gravitational forces through outlet 116 on to ball placement assembly 120 (described further below). In the dispensing position gate member 134 extends into the interior of discharge tube 112 through slots 142 to obstruct the passage of the next-in-sequence golf balls 12. As in the first embodiment of the invention, this ensures that only one ball at a time is discharged from dispenser 104 in the dispensing position. An adjustable stop member 135 is mounted on gate member 134 which contacts a microswitch 129 on the surface of discharge tube 112 when gate member 134 is rotated to the dispensing position, thereby preventing over-rotation of gate assembly 118 and ball placement assembly 120 as described below.

Figure 7:
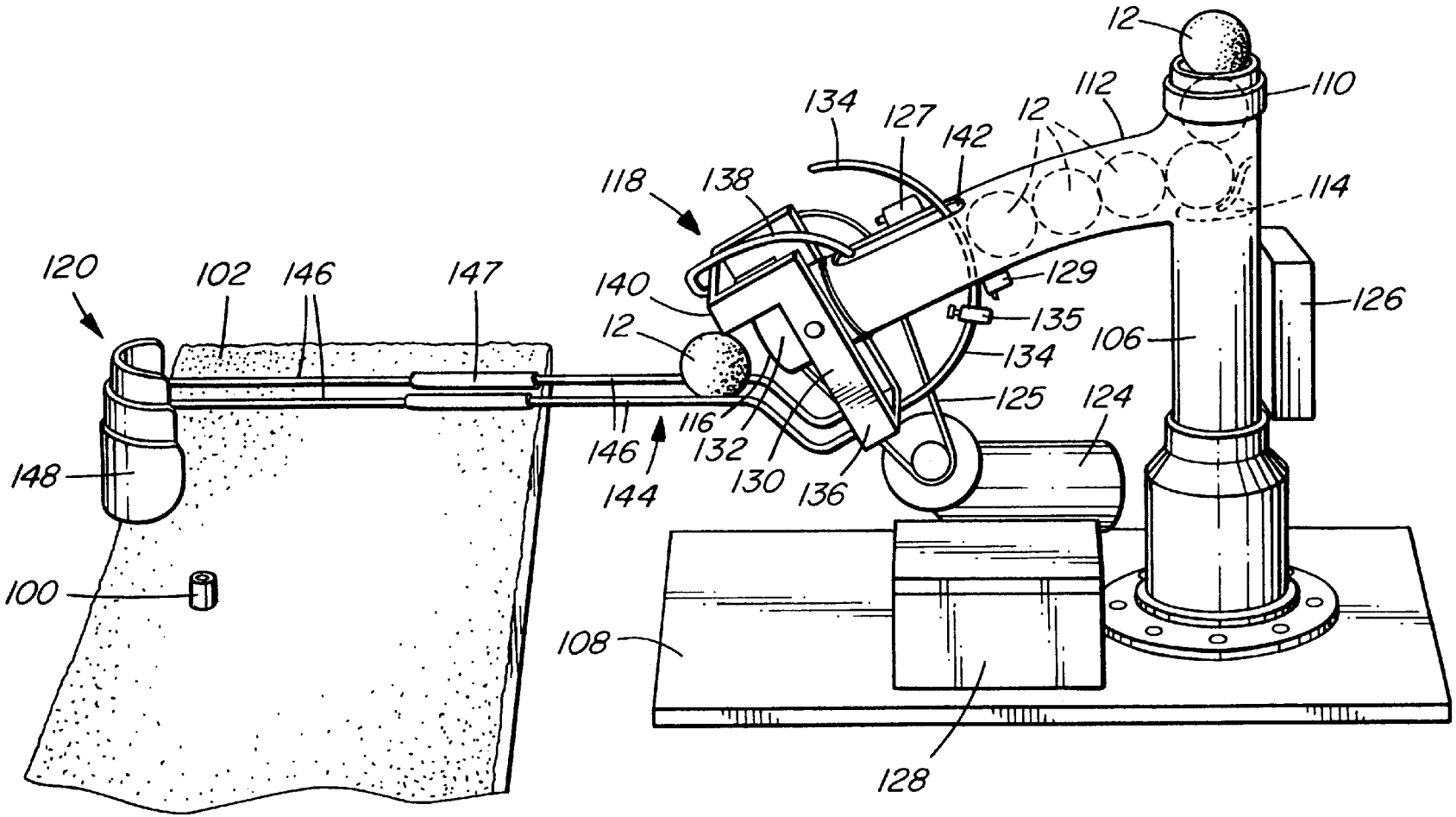
FIG. 7 is a perspective view of the apparatus of FIG. 6 in the dispensing position showing a golf ball on the run-off track.

Ball placement assembly 120 comprises a golf ball run-off track 144 having one end securely coupled to support arms 130. For example, track 144 may be bolted to a plate extending between support arms 130 at first end 136. Track 144 consists of a pair of parallel rods 146 spaced-apart a distance sufficient to support rolling movement of a golf ball therebetween (FIG. 7). Preferably the length of track 144 is adjustable in length, such as by retracting or extending an extension element 147. This permits track 144 to be adjusted to suit different tee placements or to permit a golf ball 12 to be dispensed on to hitting mat 102 rather than tee 100.

Figure 8:
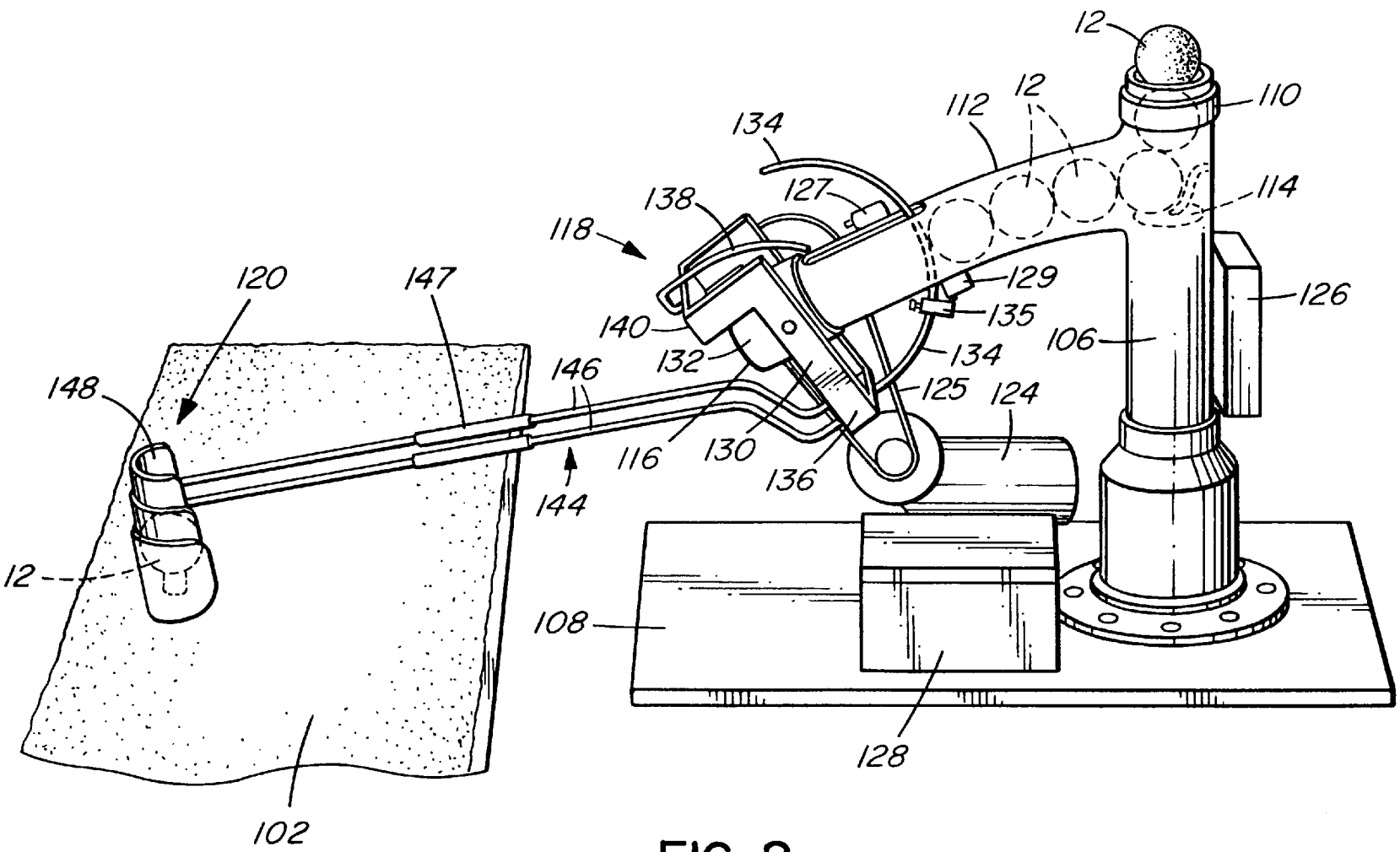
FIG. 8 is a perspective view of the apparatus of FIG. 6 in the dispensing position showing a golf ball in the guide positioned above the golf tee.

Ball placement assembly further includes a golf ball guide 148 at the free end thereof remote from discharge tube 112. Guide 148 is adapted for receiving a golf ball 12 from track 144 and setting it directly on tee 100 (FIG. 8). As indicated above, the length of track 144 is preferably adjustable to accommodate different tee placements. Also, stop member 135 is adjustable to control the vertical position of guide 148 in the dispensing position.

As shown in FIG. 11, pulley 122 is preferably coupled to one of the gate assembly support arms 130. Accordingly, rotation of pulley 122 driven by drive belt 125 causes support arms 130 to pivot relative to collar 132 surrounding discharge tube 112. This in turn causes pivoting motion of both gate assembly 118 and ball placement assembly 120 between the hold and dispensing positions as discussed above.

Reversing movement of the drive belt 125 is driven by motor 124 under the control of remote control assembly 126, which is powered by battery 128. Remote control assembly 126 preferably includes two electrical relays operatively connected to motor 124 for controlling forward and reverse movement of motor 124 according to a pre-determined timing cycle. Remote control assembly 126 is also operatively connected to first microswitch 127 mounted on an upper portion of discharge tube 112 and second microswitch 129 mounted on a lower portion of discharge tube 112. Remote control assembly 126 is designed to receive signals from a remote control trigger operable by the golfer at the striking location, such as a hand-held or belt-mountable FM frequency remote control or an infrared beam reflector remote control which is actuated with each swing.

In one embodiment, the electrical relays may have multi-contacts comprising two sets of normally open (N/O) circuits and two sets of normally close (N/O) circuits. When dispenser 104 is remotely triggered to move to the dispensing position (such as by a user pressing a remote control at the striking location) a signal is sent to remote control assembly 126. This causes the electrical relays to trigger operation of motor 124. More particularly, a first set of N/C contacts become N/O contacts and a second set of N/O contacts become N/C contacts. In this example the second set of contacts sends power to the DC motor 124, causing drive belt 125 to rotate pulley 122 in a forward direction. This in turn causes gate assembly 118 and ball placement assembly 120 to pivot to the dispensing position shown in FIG. 7, resulting in dispensation of a single golf ball 12 to ball guide 148 for placement on tee 100. In this dispensing position stopper 135 contacts microswitch 129 to disconnect the circuit and cut off power to motor 124. This ensures that ball placement assembly 120 will not overrun the preferred dispensing position, potentially resulting in slippage of belt 125. In this embodiment, microswitch 129 essentially disconnects one circuit briefly at the preferred dispensing position to allow stable placement of ball 12 on tee 100.

After a short time delay the second relay comprising the first set of N/C contacts causes motor 124 to reverse direction and pivot gate assembly 118 and ball placement assembly 120 back to the hold or stand-by position. In the hold position assembly 118 and/or assembly 120 contacts microswitch 127 to break the circuit and cut off power supply to motor 124. Thus, after the working cycle, dispenser 104 is returned from the dispensing position to the hold position automatically.

Remote control assembly 126 may include a capacitor to time the switching operations. In the hold position microswitch 129 is wired so that the capacitor is charging with battery 128. In the dispensing position stopper 135 contacts microswitch 129 to disconnect the circuit. The capacitor is therefore no longer in a charging state. Instead, the capacitor discharges to the second relay which stops operation of motor 124 until the charge of the capacitor is consumed. The second relay comprising the N/C contacts then actuates reversal of motor 124 causing assemblies 118, 120 to pivot back to the hold position after the time delay as described above until microswitch 127 is contacted.

As will be apparent to a person skilled in the art, other equivalent means for actuating pivoting motion of assemblies 118, 120 between the hold and dispensing positions may be envisioned. For example, all of the switching operations could be controlled by a microprocessor comprising integrated circuitry. In a more simplified embodiment, remote control assembly 126 could comprise a remote control door bell modified to supply electrical power to an electrical relay as described above instead of a piezo speaker. The working cycle could be, for example, 6–8 seconds in duration although a much shorter cycle could be employed. The microswitch 129 and capacitor may be used to stall operation of motor 124 during the latter part of the working (i.e. dispensing) cycle to allow stable placement of ball 12 on tee 100 and prevent slippage of drive belt 125 as described above.

If an infrared beam reflector is used as the trigger, the working (dispensing) cycle could commence, for example, after a three second time delay after the backswing of the golfer interrupts an infrared beam. In this example, working cycle could be three seconds in duration. This timing is sufficient to permit the golfer to "feel" the shot that he or she has just made before another ball is dispensed. In this embodiment the golfer can focus entirely on his or her swing throughout a practice session without the need to alter their golfing stance. This enable golfers to develop "muscle memory", thereby improving golfing skills and enhancing playing enjoyment.

In operation, a golfer standing on hitting mat 102 at the ball striking location can activate motor 124 by means of a remote control switching device and relay as described above. This enables a golfer to controllably dispense a single golf ball on to tee 100 at the striking location. As described above, when the golfer actuates motor 124, drive belt 125 causes forward (i.e. counter-clockwise) rotation of pulley 122. This in turn causes pivoting motion of gate assembly 118 and ball placement assembly 120 from the hold or stand-by position shown in FIGS. 6 and 11 to the dispensing position shown in FIG. 7. Stop member 135 mounted on gate member 134 contacts microswitch 129 located on the surface of discharge tube 112 in the dispensing position as described above to prevent over-rotation of gate assembly 118 and ball placement assembly 120 and to enable the ball 12 to stabilize on tee 100 until the working (dispensing) cycle is complete.

Figure 9:
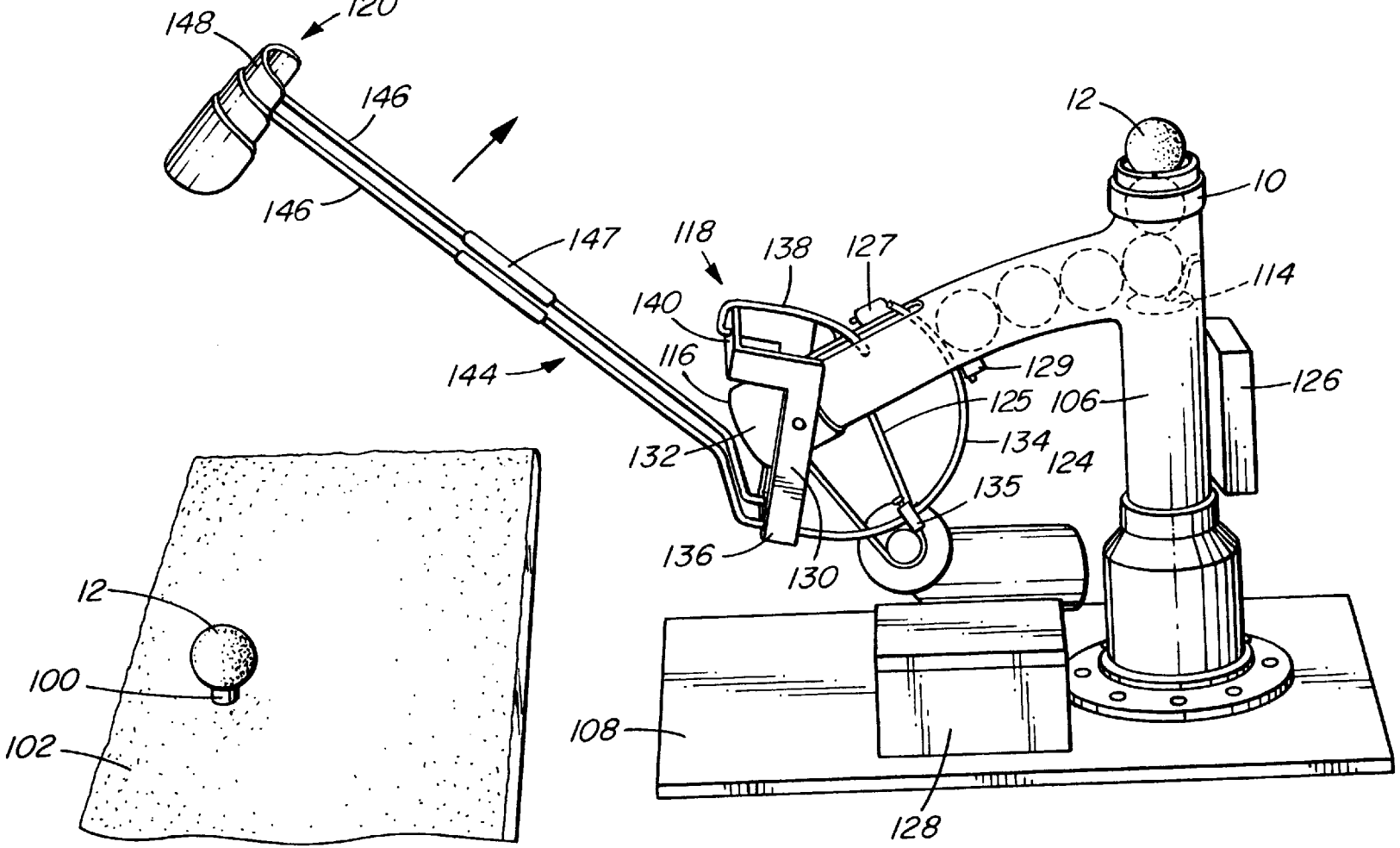
FIG. 9 is a perspective view of the apparatus of FIG. 6 shown returning from the dispensing position to the hold position.
Figure 10:
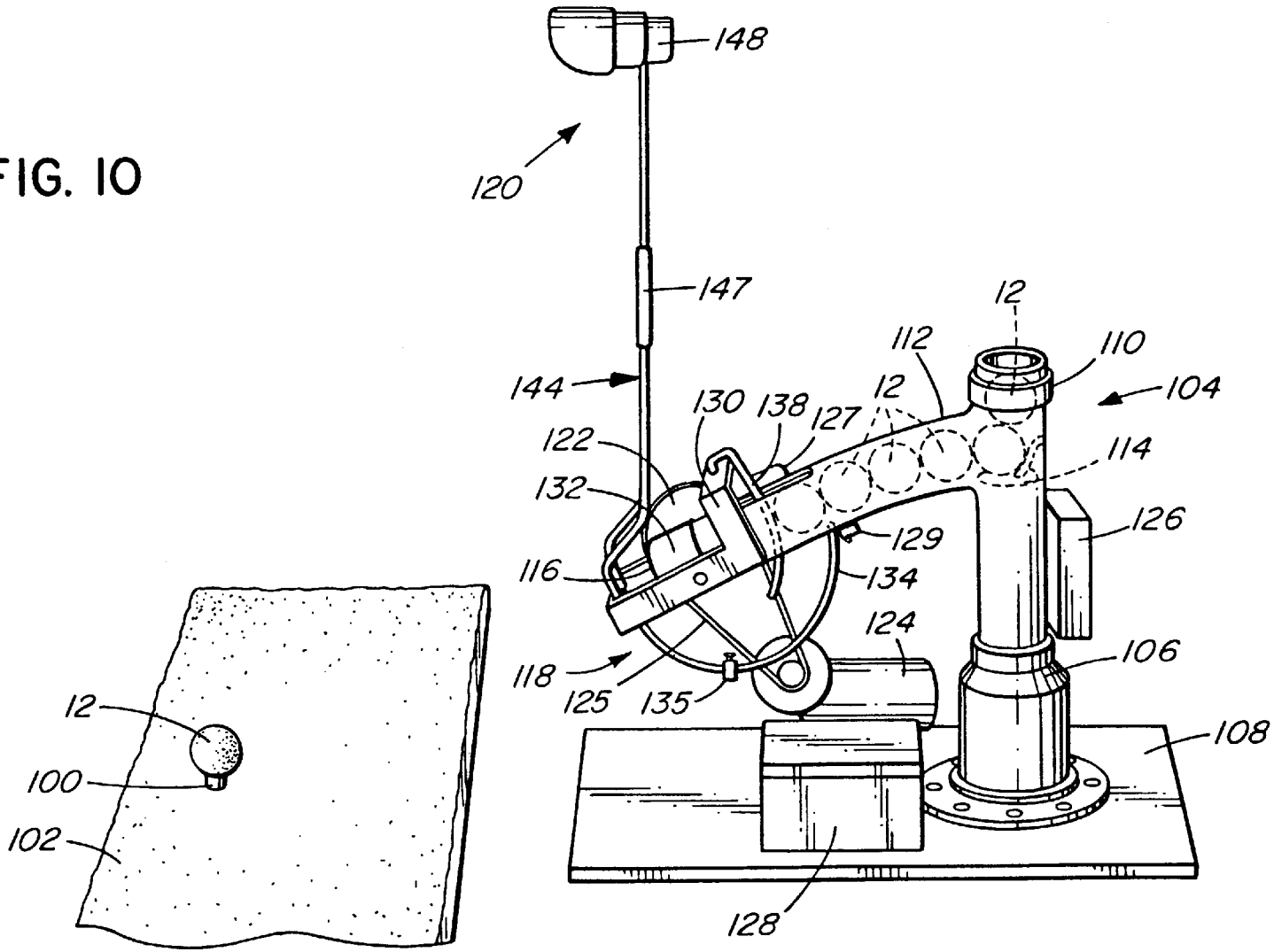
FIG. 10 is a perspective view of the apparatus of FIG. 6 shown fully returned to the hold position with the next-in-sequence golf ball advanced.

Gate member 138 is substantially retracted from the interior of discharge tube 112 in the dispensing position as discussed above which permits the forwardmost ball 12 loaded in tube 112 to roll by gravitational forces through outlet 116 on to track 144 (FIG. 7). Gate member 134 obstructs discharge of any further golf balls 12 from discharge tube 112 in the dispensing position. The single dispensed ball 12 rolls down track 144 into ball guide 148 (FIG. 8). Guide 148 gently positions the ball 12 directly on tee 100. Reversal of motor 124 is then actuated as described above to cause clockwise pivoting motion of pulley 122, thereby causing gate assembly 118 and ball placement assembly 120 to pivot back toward the hold position until assembly 118 and/or 120 contacts microswitch 127 (FIG. 9). As the gate assembly 118 pivots as aforesaid, the next-in-sequence golfball is advanced down discharge tube 112 until it rests against gate member 138 (FIG. 10). The golfer may then strike the ball 12 resting on tee 100 for practice purposes. The ball dispensing cycle described above may be repeated by the golfer as desired.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A ball dispenser controllable by a golfer for selectively dispensing golf balls one at a time to a striking location, said dispenser comprising:

(a) a passageway having an inlet for receiving said golf balls and an outlet, wherein said passageway is an elongated conduit having a longitudinal axis and wherein said conduit is inclined downwardly from said inlet to said outlet;

(b) a gate member located between said inlet and said outlet and having first and second portions moveable into said passageway to restrict the passage of said balls therethrough, wherein said gate member is pivotably coupled to a forward portion of said conduit proximate said outlet;

(c) an actuator to move said gate member between a dispensing position and a hold position, wherein:

(i) in said dispensing position, said first portion extends substantially into said passageway and said second portion retracts substantially from said passageway; and (ii) in said hold position, said first portion retracts substantially from said passageway and said second portion extends substantially into said passageway, and (d) an activator operable by the golfer at the striking location for selectively activating said actuator.

2. The apparatus of claim 1, wherein said gate member is pivotably moveable between said dispensing and hold positions.

3. The apparatus of claim 1, wherein said first and second portions are curved in an arc.

4. The apparatus of claim 1, wherein said first and second portions are radially spaced apart a distance approximating the diameter of a golf ball.

5. The apparatus of claim 1, wherein in said dispensing position said first portion physically separates a golf ball to be dispensed from any other golf balls loaded in said passageway.

6. The apparatus of claim 1, wherein said dispenser further comprises a container in communication with said passageway inlet for holding a plurality of golf balls.

7. The apparatus of claim 1, further comprising a ball placement apparatus pivotably coupled to said forward portion of said conduit for delivering a golf ball discharged from said outlet to said striking location.

8. The apparatus of claim 7, wherein said ball placement apparatus is adapted to place said ball on a tee located at said striking location.

9. The apparatus of claim 7, wherein said ball placement apparatus comprises:

(a) an elongated track pivotably coupled to said forward portion of said conduit and adapted to support rolling movement of said golf ball discharged from said outlet to said striking location; and (b) a ball placement guide mounted on an end portion of said track remote from said conduit for gently guiding said ball from said track on to said tee at said striking location.

10. The apparatus of claim 9, wherein the length of said track is extensible.

11. The apparatus of claim 9, wherein said gate member and said ball placement apparatus pivot in unison when said dispenser is adjusted between said dispensing and hold positions.

12. The apparatus of claim 1, further comprising a stop member on one of said first or second portions for limiting pivoting movement of said gate member in said dispensing position.

13. The apparatus of claim 1, wherein said actuator comprises a pulley coupled to said forward end of said conduit for actuating said pivoting movement.

14. The apparatus of claim 13, wherein said pulley is operatively coupled to a reversible motor by means of a drive belt.

15. The apparatus of claim 14, wherein said activator is operatively connected to said motor.

16. The apparatus of claim 1, wherein said inlet is sized to permit entry of a single one of said golf balls at a time.

17. A ball dispenser controllable by a golfer for selectively dispensing golf balls one at a time to a striking location, said dispenser comprising:

(a) a passageway having an inlet for receiving said golf balls and an outlet;

(b) a gate member located between said inlet and said outlet and having first and second portions moveable into said passageway to restrict the passage of said balls therethrough, wherein said first and second portions are curved in an arc;

(c) an actuator to move said gate member between a dispensing position and a hold position, wherein:

(i) in said dispensing position, said first portion extends substantially into said passageway and said second portion retracts substantially from said passageway; and (ii) in said hold position, said first portion retracts substantially from said passageway and said second portion extends substantially into said passageway, and (d) an activator operable by the golfer at the striking location for selectively activating said actuator.

18. The ball dispenser of claim 17, further comprising a ball placement apparatus pivotably coupled a forward portion of said passageway for delivering a golf ball discharged from said outlet to said striking location.

19. The ball dispenser of claim 17, wherein said gate member is pivotably coupled to a forward portion of a passageway proximate said outlet.

* * * * *